US007513189B2

(12) United States Patent
Wanschura et al.

(10) Patent No.: US 7,513,189 B2
(45) Date of Patent: Apr. 7, 2009

(54) HYDROSTATIC PISTON MACHINE WITH TWO HYDRAULIC CIRCUITS

(75) Inventors: Günter Wanschura, Ulm (DE); Juergen Gintner, Elchingen (DE); Jerzy Kreja, Nersingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 156 days.

(21) Appl. No.: 10/575,742

(22) PCT Filed: Oct. 11, 2004

(86) PCT No.: PCT/EP2004/011356

§ 371 (c)(1),
(2), (4) Date: Dec. 18, 2006

(87) PCT Pub. No.: WO2005/035980

PCT Pub. Date: Apr. 21, 2005

(65) Prior Publication Data

US 2007/0101857 A1 May 10, 2007

(30) Foreign Application Priority Data

Oct. 10, 2003 (DE) ..... 103 47 085

(51) Int. Cl.
*F01B 13/04* (2006.01)
*F01B 3/00* (2006.01)

(52) U.S. Cl. ..... 91/474; 92/71

(58) Field of Classification Search ..... 92/12.2, 92/57, 71; 91/474, 477
See application file for complete search history.

(56) References Cited

U.S. PATENT DOCUMENTS

| | | | | |
|---|---|---|---|---|
| 2,356,917 | A | 8/1944 | Chouings | |
| 3,188,963 | A | 6/1965 | Tyler | |
| 6,079,313 | A * | 6/2000 | Wolcott et al. | 92/71 |
| 2003/0136359 | A1 * | 7/2003 | Brosch et al. | 123/56.1 |
| 2003/0188530 | A1 * | 10/2003 | Inoue et al. | 60/476 |

FOREIGN PATENT DOCUMENTS

| | | |
|---|---|---|
| DE | 31 27 610 A1 | 7/1981 |
| DE | 37 27 853 A1 | 8/1987 |
| DE | 40 10 550 A1 | 4/1990 |

* cited by examiner

*Primary Examiner*—Michael Leslie
(74) *Attorney, Agent, or Firm*—Scully, Scott, Murphy & Presser, P.C.

(57) ABSTRACT

The invention relates to a hydrostatic piston engine comprising a cylinder barrel (43) inside of which a first group of cylinder bores (53.1) and a second group of cylinder bores (53.2) are made. The cylinder bores of the first group (53.1) can be connected to a first hydraulic circuit, and the cylinder bores of the second group (53.2) can be connected to a second hydraulic circuit. The cylinder bores of the first group (53.1), and the cylinder bores of the second group (53.2) are realized in the cylinder barrel (43) on a shared partial circuit (76).

9 Claims, 7 Drawing Sheets

HYDROSTATIC PISTON MACHINE WITH TWO HYDRAULIC CIRCUITS

Figure 1:
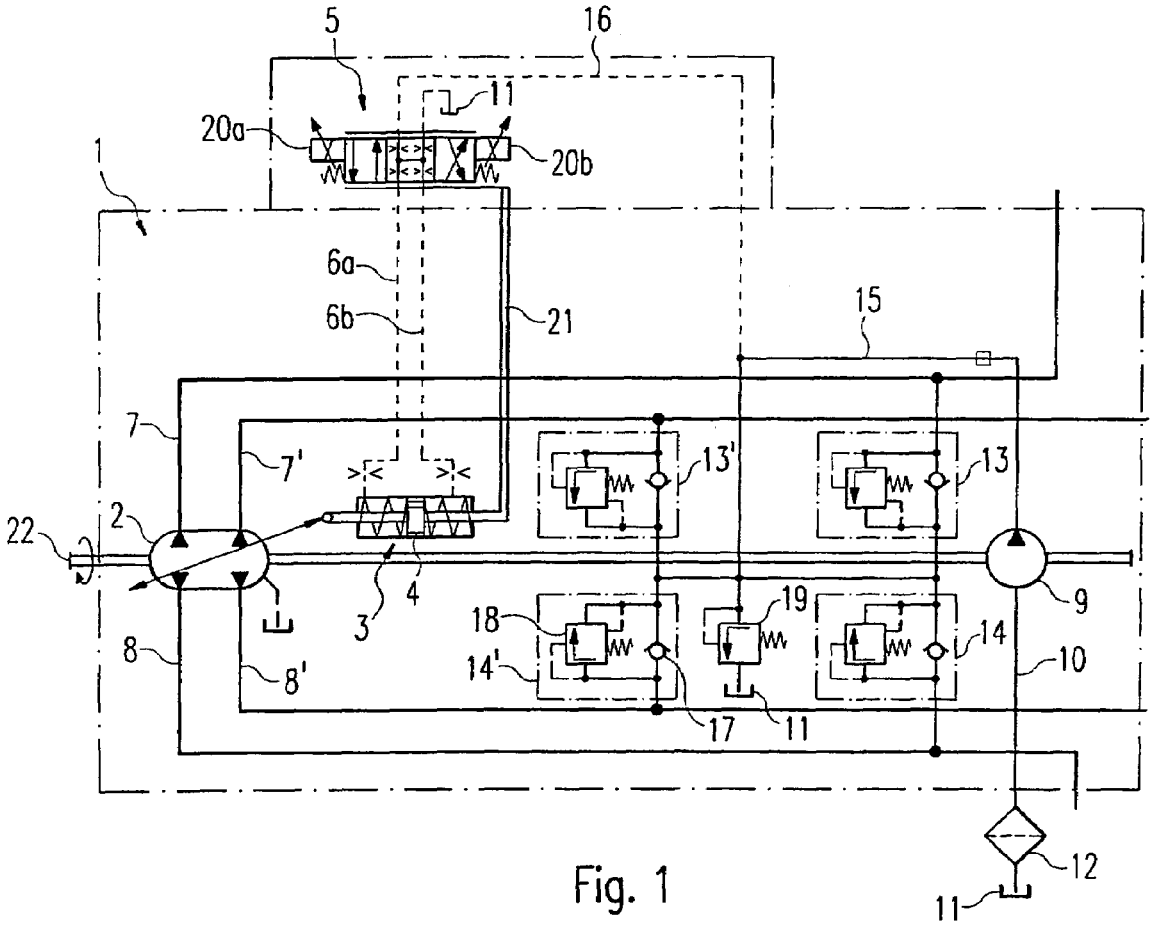

The invention relates to a hydrostatic piston machine for simultaneous operation in a first and a second hydraulic circuit.

For simultaneous operation of a hydrostatic piston machine in a first circuit and in a second hydraulic circuit, it is known from U.S. Pat. No. 3,188,963 to make a first group of cylinder bores and a second group of cylinder bores in a cylinder drum. The first group of cylinder bores is in this case arranged on a divided circle with a greater radius than the divided circle of the second group of cylinder bores. The pistons arranged in the cylinder bores of the first and of the second group are supported, at the end facing away from the connection side, on a swash plate. As a result of the different radii on which the cylinder bores of the first and second group are arranged, the pistons execute stroke movements of different extents in the cylinder bores.

In this case, it is not only disadvantageous that vibrations are produced due to the different distance of the cylinder bores from the centre axis and the resultant contact point of the pistons on the swash plate, but also that the outside diameter of the cylinder drum is increased due to the offset arrangement therein. The minimum distance from the axis of the cylinder drum is governed, inter alia, by the required stroke and the angle of the swash plate. Arrangement of the inner cylinder bores further inwards is thus not possible.

The radially outwardly offset cylinder bores assigned to the other hydraulic circuit thus increase the overall diameter of the cylinder drum and consequently the size of the entire piston machine. A further disadvantage arises from the fact that either a different number of cylinder bores is required on the inner and the outer divided circle, or else cylinder bores with different diameters have to be used, in order to be able to operate two hydraulic circuits of corresponding delivery output with the piston machine.

The object of the invention is to provide a hydrostatic piston machine which enables the operation in two mutually corresponding hydraulic circuits, with minimised space requirements.

According to the invention, the object is achieved by a hydrostatic piston machine having the features of claim 1.

The hydrostatic piston machine according to the invention comprises a cylinder drum, in which is made a first group of cylinder bores which are connectable to a first hydraulic circuit. Furthermore, a second group of cylinder bores which are connectable to a second hydraulic circuit is made in the cylinder drum. The cylinder bores of the first and of the second group are made in the cylinder drum on a common divided circle. The outside diameter of the cylinder drum is in this case not increased by a radial offset between the cylinder bores of the first group and of the second group.

The minimum diameter on which the cylinder bores are arranged is determined solely by the required delivery volume and the maximum achievable setting angle of a pivoting plate. In addition to the improved space utilisation, a further advantage of the axial piston machine according to the invention is that all the pistons arranged in the cylinder bores of the first group and of the second group are supported on the pivoting plate at just one uniform distance from the cylinder drum axis, thereby resulting in a more even loading and an improved vibration behaviour.

The subclaims relate to advantageous developments of the hydrostatic piston machine according to the invention.

The cylinder bores of the first group are connected by first connecting ducts to the first hydraulic circuit, the first connecting ducts differing from second connecting ducts by the mouth on the end face of the cylinder drum being at a different distance from the cylinder drum axis. The assignment of the individual cylinder bores of the first group is thus effected by respectively one first connecting duct which opens out at the end face of the cylinder drum at a first distance from the cylinder drum axis, while the assignment of the cylinder bores of the second group is effected via respectively one second connecting duct which opens out with a corresponding second distance from the cylinder drum axis.

In order to connect the cylinder bores at the correct times to working lines of the first and second hydraulic circuit via the first and second connecting ducts, respectively, there is provided a control plate in which at least one first kidney control port and one second kidney control port are arranged, the first and the second kidney control port each extending along a circular arc. The radius of the respective circular arc corresponds here to the distance, from the cylinder drum axis, at which the first connecting ducts and the second connecting ducts respectively open out at the end face of the cylinder drum.

One further kidney control port each is preferably assigned to the first and second hydraulic circuit. Consequently, the first hydraulic circuit and the second hydraulic circuit are completely separated from one another and each have a separate pressure and suction connection. The third kidney control port required for this extends once again along a circular arc whose radius corresponds to the radius of the circular arc along which the first kidney control port extends. Accordingly, the fourth kidney control port extends along a circular arc corresponding to the second kidney control port.

To centre the cylinder drum and also form a hydrodynamic sliding bearing at the end face of the cylinder drum, the control plate is shaped with a spherical protuberance on the side facing the cylinder drum. The spherical protuberance corresponds to a spherical indentation made in the end face of the cylinder drum. The cylinder drum bears, by the spherical indentation, against the spherical protuberance of the control plate, thereby centring the cylinder drum. To reduce the friction between the cylinder drum and the control plate, a defined leakage flow from the mouths of the connecting ducts is produced, thereby forming a hydrodynamic sliding bearing between the bearing surfaces of the control plate and the cylinder drum.

To make the connecting ducts, it is advantageous if both the first connecting ducts and the second connecting ducts extend parallel to the cylinder drum axis. Consequently, the connecting ducts can be made in a particularly simple manner in the cylinder drum, for example by milling, without having to rechuck the workpiece or change the feed angle of the tool.

In the case of cylinder bores with a small diameter, it is, by contrast, particularly advantageous to produce the different distance of the mouths from the cylinder drum axis at the end face of the cylinder drum by making at least the connecting ducts of the first or of the second group of cylinder bores at a specified angle to the cylinder drum axis. Such connecting ducts with a radial direction component make it possible, also for small diameters of the cylinder bores, to vary the distances of the mouths of the first and of the second connecting ducts in a wide range. Consequently, the control plate can be designed largely independently of the dimensions of the cylinder drum and are optimised in particular with respect to the connection plate and the strength.

If the first and/or second connecting ducts are made with a radial direction component in the cylinder drum, then it is particularly advantageous if those connecting ducts which open out at the end face of the cylinder drum with the smaller distance from the longitudinal axis of the cylinder drum are oriented, in the direction of the mouth, towards the cylinder drum axis. This results, together with the spherical indentation at the end face of the cylinder drum, in an outlet angle of approximately a right angle. This constitutes not only a simplification for production, but also leads to increased durability of the piston machine.

A further advantage with regard to the pulsation of the hydrostatic piston machine results if the number of cylinder bores of the first and the second group is identical. It is particularly advantageous in this case if both the number of cylinder bores of the first group and the number of cylinder bores of the second group in each case is an odd number. The cylinder bores of the first group and of the second group are arranged alternately along the common divided circle.

A particularly versatile hydrostatic piston machine results if the pistons, arranged longitudinally displaceably in the cylinder bores of the first and of the second group, are supported on a common pivoting plate, so that when the pivoting plate is orthogonal with respect to the cylinder drum axis the stroke of all the pistons is zero and the pivoting plate can be pivoted in both directions from this position.

Figure 2:
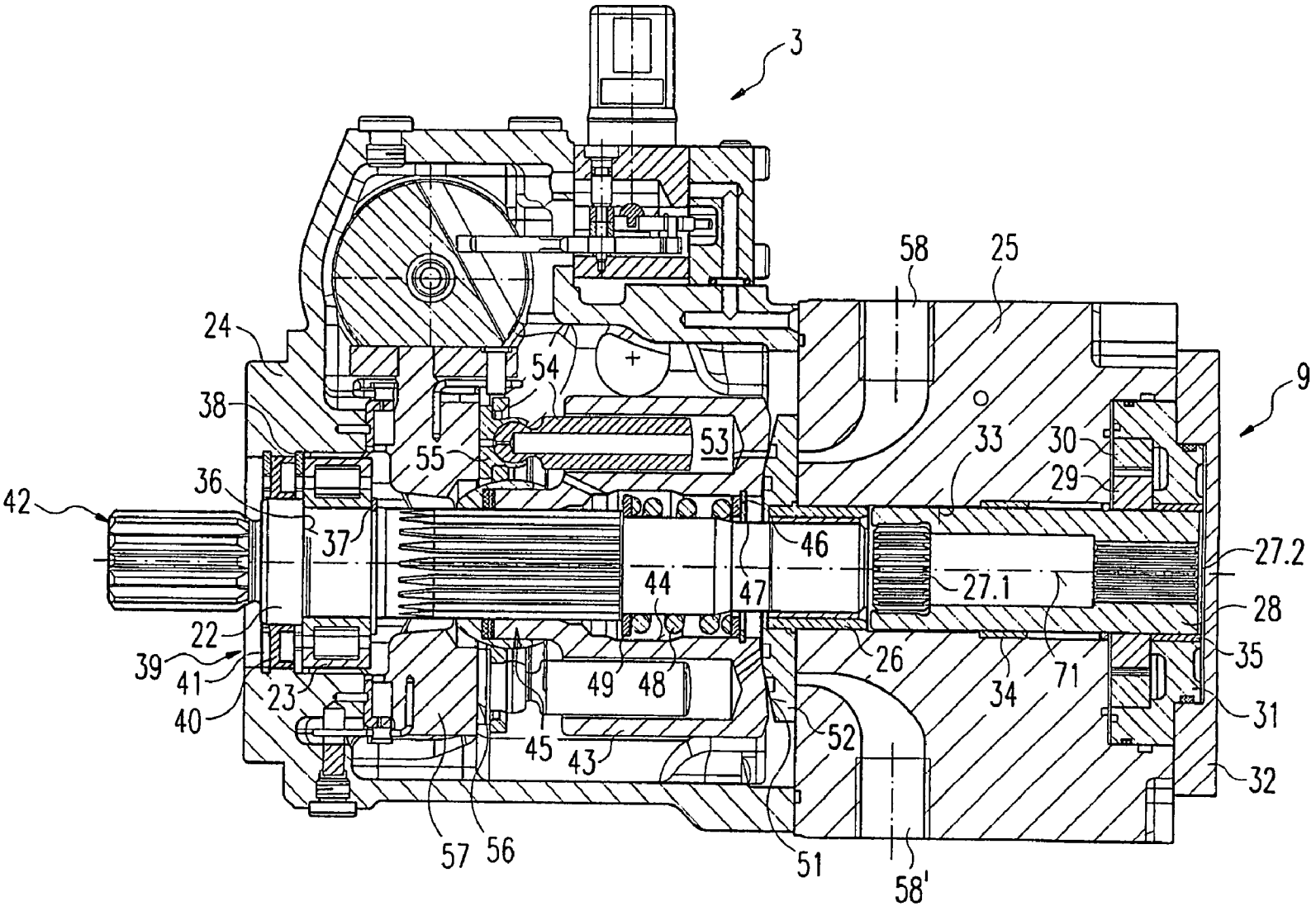
Figure 3:
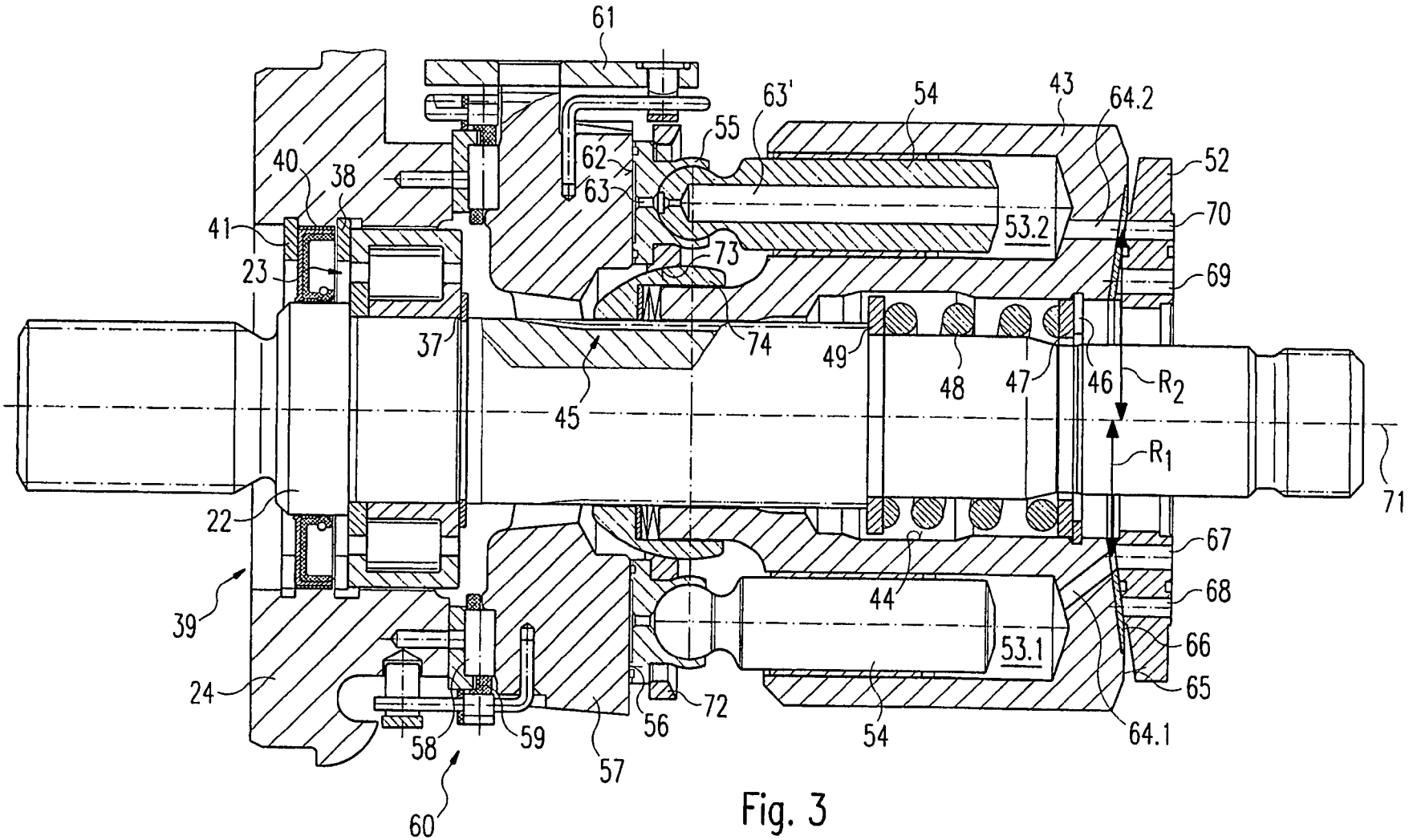
Figure 4:
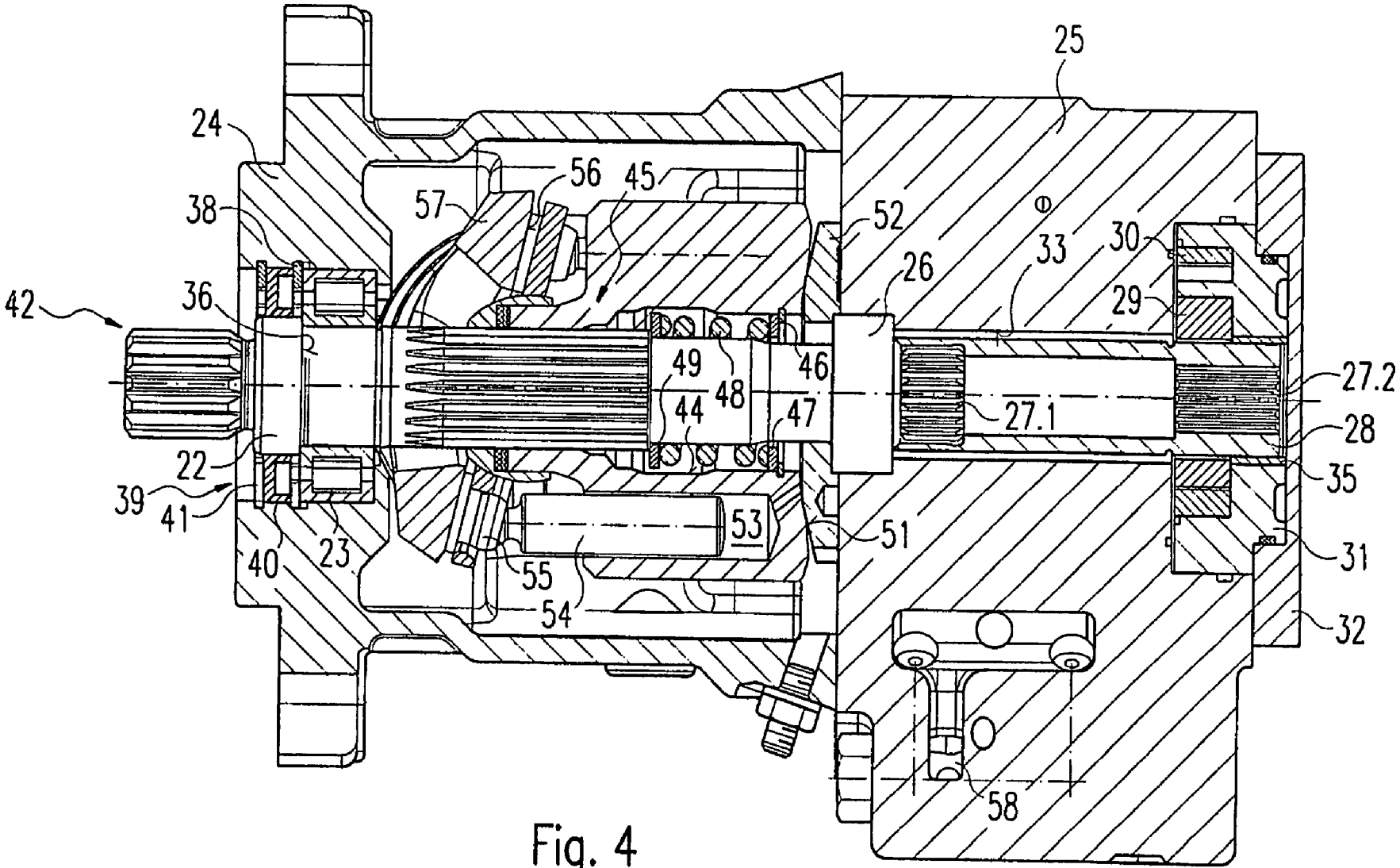
Figure 5:
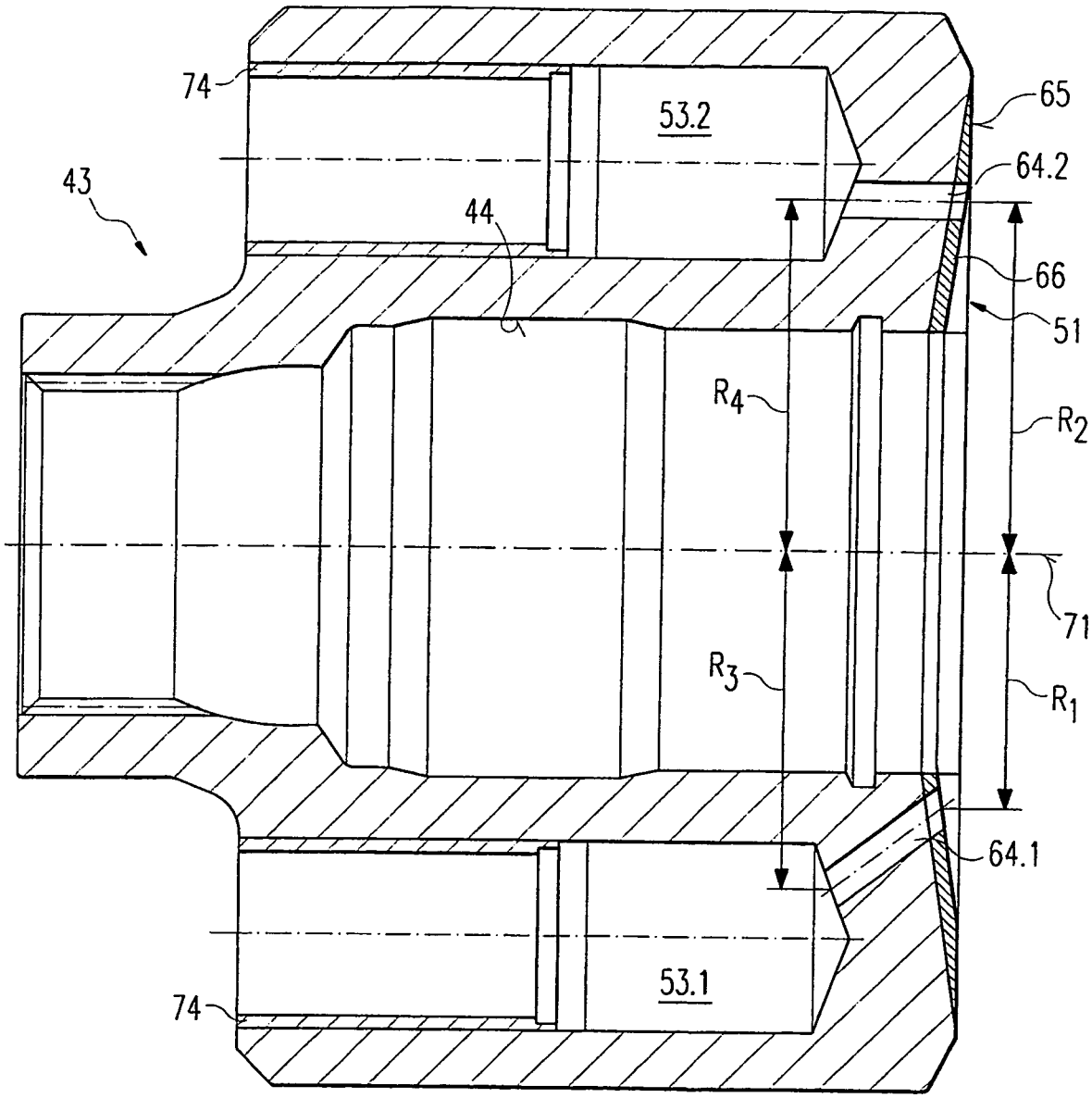
Figure 6:
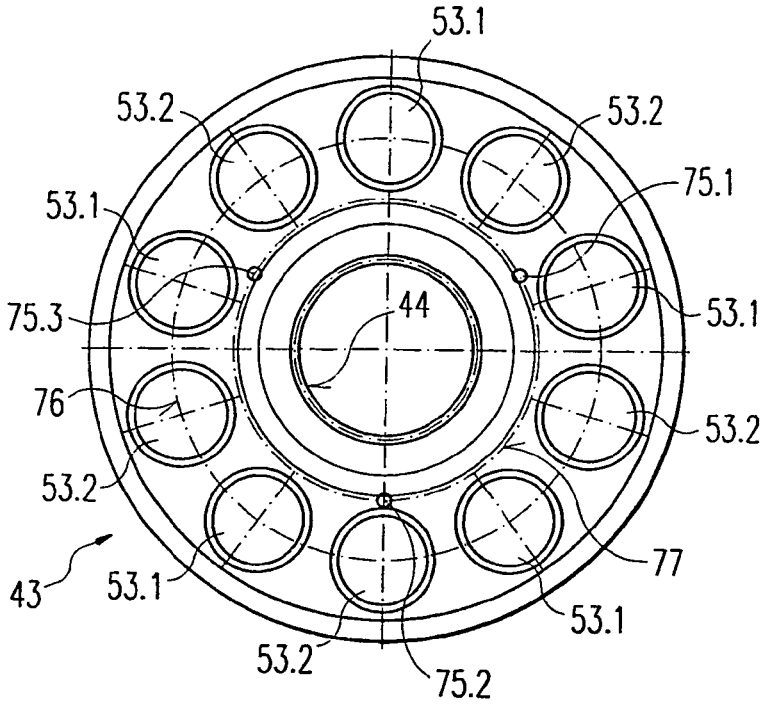
Figure 7:
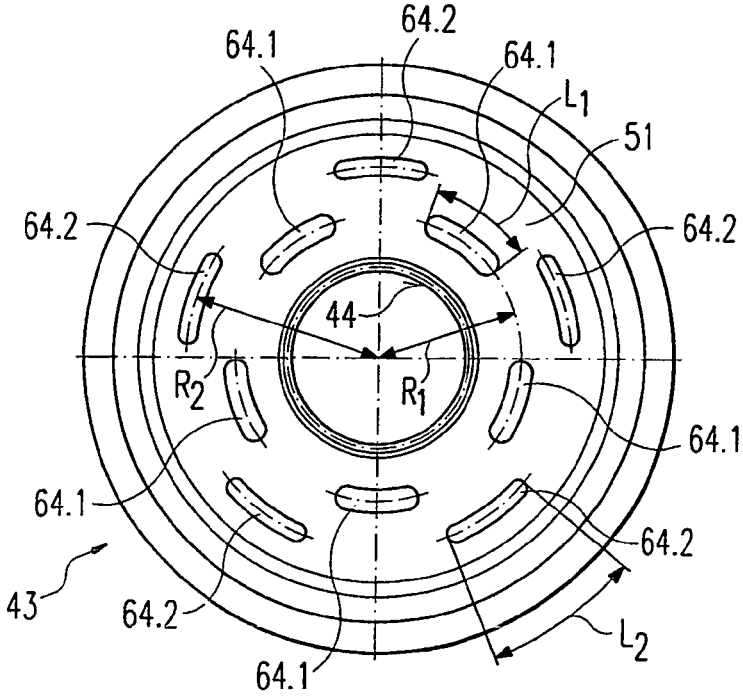
Figure 8:
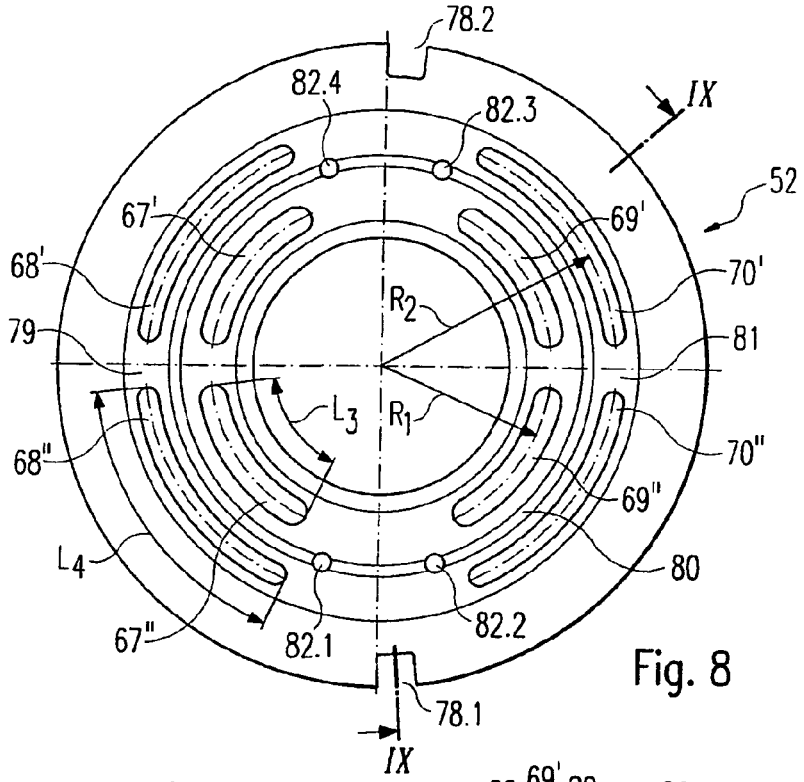
Figure 9:
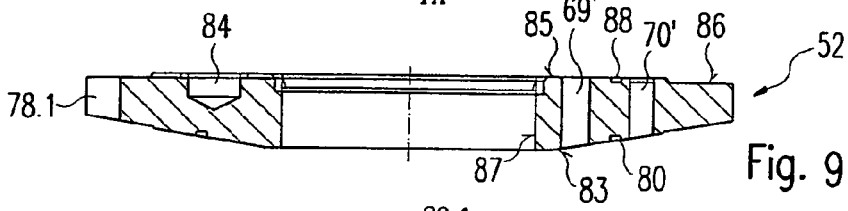
Figure 10:
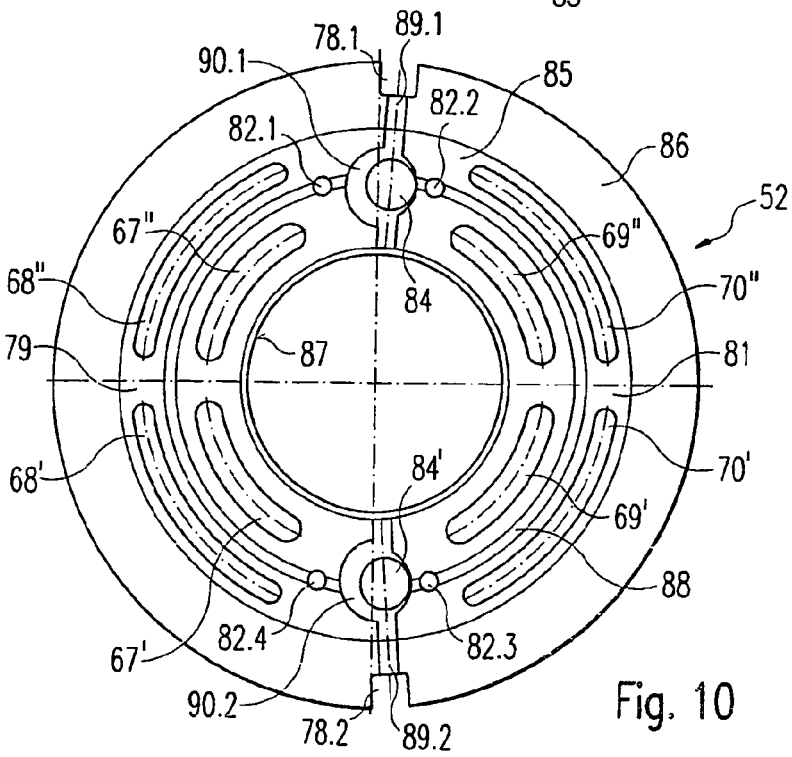

A preferred exemplary embodiment of the hydrostatic piston machine according to the invention is illustrated in the drawing and explained in the following description. In the drawing:

FIG. 1 shows a hydraulic circuit diagram of a hydrostatic piston machine according to the invention, FIG. 2 shows a longitudinal section through a hydrostatic piston machine according to the invention, FIG. 3 shows an enlarged illustration of a detail of the longitudinal section of the hydrostatic piston machine according to the invention, FIG. 4 shows an enlarged illustration of a second detail of the longitudinal section of the hydrostatic piston machine according to the invention, FIG. 5 shows a sectional illustration of a cylinder drum of the hydrostatic piston machine according to the invention, FIG. 6 shows a plan view of the cylinder drum, FIG. 7 shows a first view of the end face of the cylinder drum, FIG. 8 shows a first view of a control plate of the hydrostatic piston machine according to the invention, FIG. 9 shows a sectional illustration of the control plate of the hydrostatic piston machine according to the invention, and FIG. 10 shows a second view of the control plate of the hydrostatic piston machine according to the invention.

Before discussing the design of an exemplary embodiment of a hydrostatic piston machine 1 according to the invention in detail, the basic structure of a piston machine 1 operated in two hydrostatic circuits will first be explained with the aid of the hydraulic connection diagram in FIG. 1. In the exemplary embodiment illustrated, the hydrostatic piston machine 1 comprises a pump 2 for parallel delivery of pressure medium to two separate, closed hydraulic circuits.

The delivery rate of the pump 2 can be changed by an adjusting device 3 for both hydraulic circuits together. The adjusting device 3 comprises a cylinder and a setting piston 4, which is arranged therein and is loaded, in a known manner, at piston surfaces oriented mutually opposite, with a setting pressure in respectively one setting pressure chamber. The two setting pressure chambers are connected via respectively one setting pressure line 6*a*, 6*b* to a setting pressure regulating valve 5.

By loading one setting pressure chamber and relieving the other setting pressure chamber, a pressure difference acts on the setting piston 4 and as a result of this the setting piston 4 is deflected from its central position, in which it is held by two centring springs. Through the deflection of the setting piston 4, the pump 2 is set to a changed delivery volume. The adjustment acts both on the first and the second hydraulic circuit.

The first hydraulic circuit is formed from a first working line 7 and a second working line 8. The pump 2 delivers either to the first working line 7 or to the second working line 8. Owing to the common adjustment, in the case of a delivery to the first working line 7, pressure medium is simultaneously delivered to a first working line 7' of the second hydraulic circuit or, in the case of delivery to the second working line 8 of the first hydraulic circuit, pressure medium is simultaneously delivered to a second working line 8' of the second hydraulic circuit.

The first hydraulic circuit, comprising its first working line 7 and its second working line 8, is hydraulically independent of the second hydraulic circuit, comprising its first working line 7' and its second working line 8'.

On starting the pump 2, the first hydraulic circuit and the second hydraulic circuit are initially fed with pressure medium by an auxiliary pump 9. For this purpose, the auxiliary pump 9 sucks in pressure medium from a tank volume 11 via a suction line 10. To filter the pressure medium, a filter 12 is arranged in the suction line 10 outside the housing of the hydrostatic piston machine 1 and frees the sucked-in pressure medium of impurities.

For feeding to the first hydraulic circuit, a first high-pressure limiting valve 13 and a second high-pressure limiting valve 14 are provided, the first high-pressure limiting valve 13 being connected to the first working line 7 of the first hydraulic circuit and the second high-pressure limiting valve 14 being connected to the second working line 8 of the first hydraulic circuit. Analogously to this, a third high-pressure limiting valve 13' is connected to the first working line 7' of the second hydraulic circuit and a fourth high-pressure limiting valve 14' is connected to the second working line 8' of the second hydraulic circuit.

The first to fourth high-pressure limiting valve 13, 13', 14 and 14' are commonly connected to a feeding line 15, to which the auxiliary pump 9 delivers the sucked-in pressure medium. In a known manner, as illustrated in FIG. 1 with a reference symbol merely in the case of the fourth high-pressure limiting valve 14', respectively one nonreturn valve 17 is arranged in the high-pressure limiting valves 13 to 14', which valve opens a flow path from the feeding line 15 in the direction of the respectively connected working line 7, 8, 7' or 8' in order to feed in pressure medium, as along as the pressure in the feeding line 15 is greater than the respective working pressure. Arranged in parallel with the nonreturn valve 17 in the high-pressure limiting valves 13, 13', 14 and 14' is respectively one high-pressure limiting valve 18 which, if a critical pressure in the respective working line 7, 8, 7' or 8' is exceeded, opens in the direction of the feeding line 15.

If the pressure in the feeding line 15 rises on the opening of such a high-pressure limiting valve 18 for example, then above a limit value for the feeding line pressure a further pressure limiting valve 19 is opened, through which the feeding line 15 is relieved to the tank volume 11.

Consequently, a defined pressure level is maintained in the feeding line 15, since even in the case of an increased delivery output, by raising the auxiliary pump speed for example, the pressure limiting valve 18 opens.

The setting pressure regulating valve 5 is designed as a 4/3-way valve, which is continuously adjustable. To set a particular position, the setting pressure regulating valve 5 is loaded, starting from its neutral position, in which it is held by compression springs, with a force acting in the axial direction. This force is generated as a force difference between two proportional magnets 20*a* and 20*b*, which act with respectively one compression spring in the same direction on a valve piston of the setting pressure regulating valve 5. The respectively set position of the setting piston 4 is taken into consideration when regulating the setting pressure, in that a valve sleeve of the setting pressure regulating valve 5 is connected to the setting piston 4 via a coupling rod 21.

In order to be able to load the setting pressure chambers with a setting pressure, the setting pressure regulating valve 5 is connected to the feeding line 15 via a setting pressure supply line 16. On starting the pump 2, the adjusting device 3 can thus be actuated from the time when the auxiliary pump 9 has built up a pressure in the feeding line 15. The adjusting device 3 can thus be actuated independently of the amount of pressure medium delivered by the pump 2 to the first hydraulic circuit or second hydraulic circuit.

In the exemplary embodiment illustrated, the auxiliary pump 9 and the pump 2 are driven by a common drive shaft 22.

The longitudinal section, illustrated in FIG. 2, of the hydrostatic piston machine according to the invention shows how the common drive shaft 22 is supported at one end of a pump housing 24 by a roller bearing 23. In addition, the common drive shaft 22 is supported in a sliding bearing 26, which is arranged in a connection plate 25, which closes the pump housing 24 at the opposite end.

Formed in the connection plate 25 is an opening 33 which passes right through the connection plate in the axial direction and in which on the one hand the sliding bearing 26 is arranged and through which on the other hand the common drive shaft 22 passes. On the side of the connection plate 25 facing away from the pump housing 24, the auxiliary pump 9 is inserted into a radial widening of the opening 33. To drive the auxiliary pump 9, the common drive shaft 22 has first toothing 27.1 and second toothing 27.2, which engage with corresponding toothings of an auxiliary pump shaft 28. The auxiliary pump shaft 28 is supported in the opening 33 by a first auxiliary pump sliding bearing 34 and in the auxiliary pump connection plate 31 by a second auxiliary pump sliding bearing 35.

Arranged on the auxiliary pump shaft 28 is a gear wheel 29, which engages with an internal-geared wheel 30. Via the gear wheel 29, the internal-geared wheel 30, which is arranged rotatably in the auxiliary pump connection plate 31, is likewise driven by the auxiliary pump shaft 28 and thus ultimately by the common drive shaft 22. The suction- and the pressure-side connection for the auxiliary pump 9 are formed in the auxiliary pump connection plate 31. The auxiliary pump 9 is fixed in the radial widening of the opening 33 of the connection plate 25 by a cover 32, which is mounted on the connection plate 25.

The inner race of the roller bearing 23 is fixed in the axial direction on the common drive shaft 22. The inner race bears on one side against a collar 36 of the common drive shaft 22 and is held in this axial position on the other side by a circlip 37 which is inserted in a groove of the common drive shaft 22. The axial position of the roller bearing 23 with respect to the pump housing 24 is determined by a disc 38 which bears against a shoulder of a shaft opening 39 in the pump housing 24. In the direction of the outside of the pump housing 24, additionally a sealing ring 40 and finally a further circlip 41 are arranged in the shaft opening 39, the circlip 41 being inserted into a circumferential groove of the shaft opening 39.

Formed at the end of the common drive shaft 22 projecting from the pump housing 24 is drive toothing 42, via which the hydrostatic piston machine is driven by a prime mover (not illustrated).

Arranged in the interior of the pump housing 24 is a cylinder drum 43, having a central through-opening 44, through which the common drive shaft 22 passes. Via further drive toothing 45, the cylinder drum 43 is connected to the common drive shaft 22 in a manner locked against relative rotation but displaceable in the axial direction, so that a rotational movement of the common drive shaft 22 is transmitted to the cylinder drum 43.

Inserted into a groove formed in the central through-opening 44 is a further circlip 46, against which a first supporting disc 47 bears. The first supporting disc 47 forms a first spring bearing for a compression spring 48. A second spring bearing for the compression spring 48 is formed by a second supporting disc 49, which is supported on the end face of the further drive toothing 45. The compression spring 48 thus exerts a force in the opposite axial direction respectively on the common drive shaft 42 on the one hand and on the cylinder drum 43 on the other hand. The common drive shaft 22 is stressed such that the outer race of the roller bearing 23 is supported on the disc 38.

In the opposite direction, the compression spring 48 acts on the cylinder drum 43, which is held in contact with a control plate 52 by a spherical indentation 51 formed at the end face of the cylinder drum 43. The control plate 52, in turn, bears sealingly against the connection plate 25 by the side facing away from the cylinder drum 43. As a result of the spherical indentation 51, which corresponds with a corresponding spherical protuberance of the control plate 52, the cylinder drum 43 is centred.

The position of the control plate 52 in the radial direction is fixed by the outer circumference of the sliding bearing 26. For this purpose, the sliding bearing 26 is only partly inserted into the opening 33 in the connection plate 25.

Made in the cylinder drum 43 in a manner distributed over a common divided circle are cylinder bores 53, in which pistons 54, which are longitudinally displaceable in the cylinder bores 53, are arranged. The pistons 54 project partly from the cylinder drum 43 at the end facing away from the spherical indentation 51. At this end, respectively one slide shoe 55 is fastened to the pistons 54, via which the pistons 54 are supported on a running surface 56 of a pivoting plate 57.

To produce a stroke movement of the pistons 54, the angle which the running surface 56 of the pivoting plate 57 encloses with the centre axis, can be changed. For this purpose, the pivoting plate 57 can be adjusted in its inclination by the adjusting device 3. To absorb the forces transmitted by the slide shoes 55 to the pivoting plate 57, the pivoting plate 57 is supported by a roller bearing in the pump housing 24.

To connect the hydrostatic piston machine 1 to a first hydraulic circuit and to a second hydraulic circuit, a first high-pressure connection 58 and a second high-pressure connection 58' are illustrated schematically in the connection plate 25, and these connections can be connected, in a manner not shown, to the cylinder bores 53 via the control plate 52.

An enlarged illustration of the components cooperating in the interior of the pump housing 24 is illustrated in FIG. 3.

On its side facing away from the running surface 56, the pivoting plate 57 is supported on a cylindrical roller bearing 58, the cylindrical rollers of which are held by a bearing cage 59. In order to ensure reliable return of the cylindrical rollers to their starting position after each pivoting movement, the bearing cage 59 is fastened to a securing mechanism 60, as a result of which the bearing cage 59 executes a controlled movement both on pivoting out and on pivoting back.

To execute a pivoting movement, the pivoting plate 57 is coupled to a sliding block 61 which, in a manner not illustrated, rotates the pivoting plate 57 about an axis lying in the plane of the drawing.

The cylinder bores, denoted generally by 53 in FIG. 2, are subdivided into a first group of cylinder bores 53.1 and a second group of cylinder bores 53.2. As has already been explained briefly in the embodiments relating to FIG. 2, respectively one slide shoe 55 is arranged at the end of the pistons 54 facing away from the control plate 52. The slide shoe 55 is fastened by a recess to a spherical head of the piston 54, so that the slide shoe 55 is fixed movably to the piston 54 and tensile and compressive forces can be transmitted.

Formed on the slide shoe 55 is a sliding surface 62, by which the slide shoe 55 and hence the piston 54 is supported on the running surface 56 of the pivoting plate 57. Formed in the sliding surface 62 are lubricating oil grooves, which are connected, via a lubricating oil duct 63 formed in the slide shoe 55 and continued in the piston 54 as a lubricating oil bore 63', to the cylinder bores 53 formed in the cylinder drum 43.

As a result of the support of the slide shoes 55 on the running surface 56, the pistons 54 execute a stroke movement on rotation of the common drive shaft 22, which movement pressurises the pressure medium situated in the cylinder spaces in the cylinder drum 43. Some of this pressure medium emerges at the sliding surface 62 and thus forms on the running surface 56 a hydrodynamic bearing for the slide shoe 55.

In order to deliver the pressure medium from the cylinder spaces to the first and second hydraulic circuit, respectively, first connecting ducts 64.1 and second connecting ducts 64.2 are each connected to the cylinder bores of the first group 53.1 and the cylinder bores of the second group 53.2, respectively. The first and second connecting ducts 64.1 and 64.2 run from the cylinder bores of the first group 53.1 and the cylinder bores of the second group 53.2, respectively, to the spherical indentation 51 formed at an end face 65 of the cylinder drum 43.

A hardened region 66, for example, is formed on the cylinder drum 43 along the contact surface between the spherical indentation 51 of the cylinder drum 43 and the corresponding spherical protuberance of the control plate 52, in order to reduce the wear. Formed in the control plate 52, connected in a manner locked against relative rotation to the connection plate 25, are a first kidney control port 67 and a second kidney control port 68, which pass through the control plate 52 in the axial direction.

Furthermore, preferably a third kidney control port 69 and a fourth kidney control port 70 are formed in the control plate 52. While the first and the third kidney control port 67 and 69, respectively, are connected via the connection plate 25 to working lines 7 and 8, respectively, of the first hydraulic circuit, correspondingly the second kidney control port 68 and the fourth kidney control port 70 are connected to the working lines 7' and 8', respectively, of the second hydraulic circuit. The geometrical configuration of the kidney control ports 67 to 70 in the control plate 52 will be explained below with reference to FIGS. 8 to 10.

The first and third kidney control port 67 and 69 are at an identical first distance $R_1'$ from the longitudinal axis 71 of the cylinder drum 43, which is less than the second distance $R_2'$, once again identical, for the second kidney control port 68 and the fourth kidney control port 70 from the longitudinal axis 71. During a rotation of the common drive shaft 22, the first connecting ducts 64.1 are connected alternately to the first kidney control port 67 and the third kidney control port 69, so that owing to the stroke movement of the pistons 54 arranged in the cylinder bores 53.1 of the first group, the pressure medium is sucked in, for example, via the third kidney control port 69 and pumped into the pressure-side working line 7 or 8 of the first hydraulic circuit via the first kidney control port 67. For this purpose, the first connecting ducts 64.1 open out at the end face 65 of the cylinder drum 43 at a first distance $R_1$ from the longitudinal axis 71 of the cylinder drum 43 corresponding to the first distance $R_1'$ of the first and 3rd kidney control port 67 and 69, respectively, from the longitudinal axis 71 of the cylinder drum 43.

In the exemplary embodiment illustrated, the first connecting ducts 64.1 are arranged in the cylinder drum 43 in such a way that they have a radial direction component, as a result of which the first distance $R_1$ of the mouth at the end face 65 is less than the distance on the opposite side of the first connecting ducts 64.1. The second connecting ducts 64.2 accordingly open out at the end face 65 of the cylinder drum 43 with a distance $R_2$ corresponding to a second distance $R_2'$ of the second and fourth kidney control port 68 and 70 from the longitudinal axis 71. During a rotation of the common drive shaft 22, the cylinder bores of the second group 53.2 are thus connected via the second connecting ducts 64.2 alternately to the second and fourth kidney control port 68 and 70.

In order to prevent the slide shoes 55 from lifting off from the running surface 56 of the pivoting plate 57 during a suction stroke, there is provided a holding-down plate 72 which encompasses the slide shoes 55 at a shoulder provided therefor. The holding-down plate 72 has a spherical, central opening 73, by which it is supported on a supporting head 74 arranged at the end of the cylinder drum 43 facing away from the end face 65.

FIG. 4 illustrates a further section through a piston machine according to the invention. In contrast to FIGS. 2 and 3, the section plane does not coincide with the pivoting axis of the pivoting plate 57. The pivoting plate 57 is illustrated in a pivoted-out state. From this it follows immediately that the delivered volume is dependent on the angle of the pivoting plate 57 and the distance of the slide shoes 55 from the longitudinal axis 71 of the cylinder drum 43.

FIG. 5 shows an enlarged illustration of the cylinder drum 43. The cylinder drum 43 is rotationally symmetrical with respect to its longitudinal axis 71. The hardened region 66 can be seen in the region of the spherical indentation 51 formed at the end face 65. The first connecting ducts 64.1 as well as the second connecting ducts 64.2 open out in this hardened region 66 at the end face 65.

The first connecting ducts 64.1 open out at the end face at a first distance $R_1$ from the longitudinal axis 71. The second connecting ducts 64.2, by contrast, open out at the end face 65 at a distance $R_2$ from the longitudinal axis 71 which is greater than the first distance $R_1$. The first connecting ducts 64.1 open out with a third distance $R_3$ into the cylinder bores of the first group 53.1, the third distance $R_3$ being identical, in the exemplary embodiment illustrated, to a fourth distance $R_4$, at which the second connecting ducts 64.2 open out into the cylinder bores of the second group 53.2.

In the exemplary embodiment illustrated in FIG. 5, the different first and second distance $R_1$ and $R_2$ of the mouths of the first and second connecting ducts 64.1 and 64.2, respectively, at the end face 65 of the cylinder drum 43 is realised by the fact that the first connecting ducts 64.1 have a radial direction component. The radial direction component is chosen here such that the first distance $R_1$ is less than the third distance $R_3$.

If, owing to the geometry of the control plate 52, which may also be of plane design, a greater difference between the first distance $R_1$ and the second distance $R_2$ is required, then, in contrast to the illustration of FIG. 5, the second distance $R_2$ may also be chosen greater than the fourth distance $R_4$, so that the second connecting ducts 64.2 also have a radial direction component.

A further measure for achieving a greater freedom with respect to the distance of the mouths of the first and second connecting ducts 64.1 and 64.2, respectively, from the longitudinal axis 71 is to have the first connecting ducts 64.1 and the second connecting ducts 64.2 opening out into the cylinder bores of the first group 53.1 and into the cylinder bores of the second group 53.2, respectively, with different distances $R_3$ and $R_4$ from the longitudinal axis 71.

Alternatively, it is also possible to design the first connecting ducts 64.1 and the second connecting ducts 64.2 in each case parallel to the longitudinal axis 71. In this case, the first distance $R_1$ is then identical to the third distance $R_3$, the first and third distance $R_1$ and $R_3$ being less than the second and fourth distance $R_2$ and $R_4$, which for their part are again identical. Such an arrangement is advantageous when large diameters of the cylinder bores 53 are present, so that a sufficiently large offset between the first connecting ducts 64.1 and the second connecting ducts 64.2 can be achieved.

In FIG. 5 it can further be seen that bushings 74 are in each case inserted into the cylinder bores of the first group 53.1 as well as into the cylinder bores of the second group 53.2. The bushings 74 are made of a material which withstands higher loading than the material of the cylinder drums 43. Consequently, the cylinder drum 43 itself can be produced from a material which is easy to process and not suitable for the direct insertion of the pistons 54. The hardened region 66 is formed at the end face 65 in the region of contact with the control plate 52, and withstands the high compressive loads which occur there and the friction.

FIG. 6 shows a plan view of the cylinder drum 43 from the side of the pivoting plate 57. The cylinder bores of the first group 53.1 and the cylinder bores of the second group 53.2 are uniformly distributed and arranged alternately over a common divided circle 76. The cylinder bores of the first group 53.1 and the cylinder bores of the second group 53.2 have an identical diameter.

In total, ten cylinder bores 53 are made in the cylinder drum 43 in the exemplary embodiment illustrated. Out of the total of ten cylinder bores 53, in each case five cylinder bores are assigned to the first group 53.1 and five cylinder bores are assigned to the second group 53.2. The symmetrical arrangement and an identical number of cylinder bores of the first group 53.1 and cylinder bores of the second group 53.2 improve the pulsation behaviour of the axial piston machine. In particular, it is advantageous here for the first group and the second group to contain an identical, odd number of cylinder bores 53.

Three run-off bores 75.1, 75.2 and 75.3, via which pressure medium which has run off into the central through-opening 44 of the cylinder drum 43 runs off into the interior of the pump housing 24, are arranged in a manner likewise uniformly distributed over a common further divided circle 77. Consequently, a pressure build-up due to the pressure medium entering the central through-opening 44 between the end face 65 of the cylinder drum 43 and the control plate 52 is prevented.

The end face 65 of the cylinder drum 43 is illustrated as a plan view in FIG. 7. The mouths of the first connecting ducts 64.1 are of kidney-shaped design and open out in the region of the spherical indentation 51 on a circle with the first radius $R_1$. The kidney-shaped mouths of the first connecting ducts 64.1 each have an identical geometry. They extend here over a first length $L_1$ along a circular arc with the first radius $R_1$, the kidney-shaped mouths being arranged symmetrically with respect to the circular arc.

The mouths of the second connecting ducts 64.2 are likewise of kidney-shaped design and each extend with a second length $L_2$ along a circular arc with the second radius $R_2$. The kidney-shaped mouths of the second connecting ducts 64.2 are likewise arranged symmetrically with respect to the circular arc with the second radius $R_2$, the width of the mouths in the radial direction being less than the width of the mouths of the first connecting ducts 64.1. At the same time, the second length $L_2$ of the mouths of the second connecting ducts 64.2 is greater than the first length $L_1$ of the mouths of the first connecting ducts 64.1, so that the opening cross-section of the mouths of the first connecting ducts 64.1 is identical to the opening cross-section of the mouths of the second connecting ducts 64.2.

FIG. 8 shows a plan view of a control plate 52 of a hydrostatic piston machine 1 according to the invention. To ensure that the control plate is installed in the correct position in a piston machine according to the invention, two recesses 78.1 and 78.2 are provided at the outer circumference of the control plate 52.

The first kidney control port 67 in the exemplary embodiment illustrated comprises a first section 67' and a second section 67". Each of the two sections 67' and 67" is of kidney-shaped design. The two kidney-shaped sections 67' and 67" each have an identical third length $L_3$ and extend along a circular arc with a first kidney control port radius $R_1'$ which is in particular identical to the first radius $R_1$ of the mouths of the first connecting ducts 64.1. For strength reasons, a first separating web 79 is formed between the first section 67' and the second section 67" of the first kidney control port 67. As regards their width, the first section 67' and the second section 67" of the first kidney control port 67 are arranged symmetrically with respect to the circular arc with the first kidney control port radius $R_1'$. Depending on the angle of rotation of the common drive shaft 22, the mouths of the first connecting ducts 64.1 are therefore in coincidence with the first section 67' or the second section 67" of the first kidney control port 67.

Analogously to the configuration of the first kidney control port 67, the second kidney control port 68 is also formed by a first section 68' and a second section 68". The two sections 68' and 68" of the second kidney control port 68 are once again each of kidney-shaped design and are likewise separated from one another by the first separating web 79. The two sections 67' and 67" of the first kidney control port 67 and the two sections 68' and 68" of the second kidney control port 68 are in each case arranged symmetrically with respect to the separating web 79.

The sections 68' and 68" of the second kidney control port 68 extend along a circular arc with the second kidney control port radius $R_2'$, their width being less than the width of the sections 67' and 67" of the first kidney control port 67. The kidney-shaped sections 68' and 68" are arranged likewise symmetrically with respect to the circular arc with the second kidney control port radius $R_2'$. The second kidney control port radius $R_2'$ is preferably identical to the second radius $R_2$.

In particular, it is advantageous to choose the width of the sections 68' and 68" of the second kidney control port 68 to match to width of the mouths of the second connecting ducts 64.2. Consequently, the second connecting ducts 64.2 come into complete coincidence with the sections 68' and 68" of the second kidney control port 68 in dependence on the angle of rotation of the common drive shaft 22 and of the cylinder drum 43. The first section 68' and the second section 68" of the second kidney control port 68 extend with a fourth length $L_4$ along the circular arc with the second kidney control port radius $R_2'$. The control times of the axial piston machine are set by the chosen lengths and the position of the kidney-shaped sections on the respective circular arcs.

Diametrically opposite, a first section 69' and a second section 69" of the third kidney control port 69 and also a first section 70' and a second section 70" of the fourth kidney control port 70 are made in the control plate 52. The geometry and arrangement of the third kidney control port 69 corresponds to that of the first kidney control port 67 and the geometry and arrangement of the fourth kidney control port 70 corresponds to that of the second kidney control port 68. A second separating web 81 is formed, likewise diametrically to the first separating web 79, between the first sections 69', 70' and the second sections 69", 70" of the third and fourth kidney control port 69 and 70, respectively. To avoid repetition, renewed detailed explanation will be dispensed with.

A groove 80 running all the way round is made in the control plate 52 between the first kidney control port 67 and the second kidney control port 68, and between the third and the fourth kidney control port 69 and 70. Provided in the groove 80 running all the way round are return bores 82.1, 82.2, 82.3 and 82.4 which serve to return pressure medium which comes out of the hydrodynamic sliding bearing and into the groove 80 running all the way round. The groove 80 running all the way round provides hydraulic relief of the spherical protuberance of the control plate 52 in the region of the first and third kidney control port 67 and 69 and of the second and fourth kidney control port 68 and 70 independently of one another.

Consequently, for each hydraulic circuit a separate hydrodynamic sliding bearing is formed between the cylinder drum 43 and the control plate 52. Via the return bores 82.1 to 82.4, the pressure medium is likewise returned to the interior of the pump housing 24 on the side facing away from the cylinder drum 43.

FIG. 9 shows a section through a control plate 52 along the line IX-IX of FIG. 8. There, it can be seen that the first sections 69' and 70', illustrated in FIG. 9, of the third and fourth kidney control port 69 and 70, respectively, are arranged in a region with a spherical protuberance 83. The groove 80 running all the way round is arranged therebetween. A centring bore 84, which serves to receive a centring pin (not illustrated), is made in the control plate 52, in the region of the first recess 78.1 at the outer circumference of the control plate 52, radially inwardly offset and from the side of the connection plate 26.

In order to ensure a correct position with respect to the longitudinal axis 72 of the axial piston machine, an inner centring bore 87 of multi-stepped design is made in the control plate 52. As has already been briefly mentioned in the explanation of FIG. 2, the part of the sliding bearing 26 protruding from the connection plate 25 projects into this inner centring bore 87. Owing to the multi-stepped design of the inner centring bore 87, an outer circumferential collar may be formed on the sliding bearing 26 and serves as a stop on insertion into the opening 33 of the connection plate 25.

Proceeding from the outer circumference of the inner centring bore 87 on the side facing away from the cylinder drum 43, and extending radially outwards, a plane region 85 is formed on the control plate 52, by which the control plate 52 bears sealingly against a corresponding plane surface of the connection plate 25. The plane region 85 does not extend over the entire diameter of the control plate 52, but leaves a set-back region 86 free in the radially outer region of the control plate 52. In this region 86 set back with respect to the plane region 85 there results a gap between the control plate 52 and the connection plate 25, via which gap the pressure medium carried off by the return bores 82.1 to 82.4 flows off into the interior of the pump housing 24.

Arranged in the plane region 85 is a further groove 88 running all the way round, the radius of which is identical to the radius of the groove 80 running all the way round. Consequently, the groove 80 running all the way round and the further groove 88 running all the way round are connected to one another via the return bores 82.1 to 82.4.

The outlet of the return bores 82.1 to 82.4 into the further groove 88 running all the way round is shown by the view of the control plate 52 from the side of the connection plate 25. From the first recess 78.1 and the second recess 78.2 which are arranged at the outer circumference of the control plate 52, a first run-off groove 89.1 and a second run-off groove 89.2 run in the radial direction to the inner centring bore 87. In the region in which the first run-off groove 89.1 and the second run-off groove 89.2 intersect the further groove 88 running all the way round, in each case a widened region 90.1 and 90.2, respectively, is formed. As a result of the widened region 90.1 and the widened region 90.2, a leakage path for the pressure medium is preserved even when a centring pin is inserted into the centring bore 84 and a corresponding centring bore 84', respectively.

The pressure medium which flows off, via the groove 80 running all the way round and the return bores 82.1 to 82.4, into the further groove 88 running all the way round is thus carried off via the widened region 90.1 or the widened region 90.2 and the adjoining run-off grooves 89.1 and 89.2, respectively, into the outer region of the control plate 52 and thus the interior of the pump housing 24.

In the hydrostatic piston machine according to the invention, use is made of a piston machine for a first closed hydraulic circuit and a second closed hydraulic circuit separated therefrom, the cylinder bores 53 being arranged on a single, common divided circle 76 in the cylinder drum 43. The assignment of the cylinder bores 53 to the first and second hydraulic circuit is effected via first connecting ducts 64.1 and second connecting ducts 64.2, respectively, which are likewise arranged in the cylinder drum 43.

The mouths of the first connecting ducts 64.1 and of the second connecting ducts 64.2 have a different distance from the longitudinal axis 71 of the cylinder drum 43, this different distance corresponding respectively to the arrangement of the first and third kidney control port 67 and 69 and second and fourth kidney control port 68 and 70 of a control plate 52, which belong to the respective first and second hydraulic circuit.

To reduce pulsations of the piston machine 1, the same odd number of cylinder bores 53 are preferably assigned to each hydraulic circuit. To produce the necessary different distance of the mouths of the first connecting ducts 64.1 and of the second connecting ducts 64.2, the connecting ducts may be arranged either radially offset from one another but parallel to the longitudinal axis 72 in the cylinder drum 43, or else have a radial direction component.

Preferably, in this regard, those connecting ducts 64.1 or 64.2 which open out at the end face 65 of the cylinder drum 43 with a smaller distance from the longitudinal axis 72 have a radial direction component oriented towards the control plate 52 in the direction of the longitudinal axis 72. This results, together with the spherical protuberance 83 of the control plate 52 and the corresponding spherical indentation 51 of the cylinder drum 43, in an outlet angle of approximately 90° for the first connecting ducts 64.1 and the second connecting ducts 64.2, which has a beneficial effect on the strength.

The invention is not restricted to the exemplary embodiment illustrated. All the features described can be combined with one another as desired.

The invention claimed is:

1. Hydrostatic piston machine with a cylinder drum, in which a first group of cylinder bores and a second group of cylinder bores are made, the cylinder bores of the first group being connectable to a first hydraulic circuit and the cylinder bores of the second group being connectable to a second hydraulic circuit, the cylinder drum being connected to a drive shaft in a manner locked against relative rotation in order to transmit a rotary movement, and the cylinder bores of the first group and the cylinder bores of the second group being made in the cylinder drum on a common divided circle, the cylinder bores of the first group are being connectable to the first hydraulic circuit via first connecting ducts which open out at an end face of the cylinder drum with a first distance ($R_1$) from the longitudinal axis of the cylinder drum, and the cylinder bores of the second group are being connectable to the second hydraulic circuit via second connecting ducts which open out at the end face of the cylinder drum with a different, second distance ($R_2$) from the longitudinal axis of the cylinder drum, a first kidney control port being connected to the first hydraulic circuit is made in a control plate and extends along a circular arc with a first radius ($R_1'$) corresponding to the first distance ($R_1$) of the mouths of the first connecting ducts from the longitudinal axis of the cylinder drum, a second kidney control port being connected to the second hydraulic circuit is made in the control plate and extends along a circular arc with a different, second radius ($R_2'$) corresponding to the second distance ($R_2$) of the mouths of the second connecting ducts from the longitudinal axis of the cylinder drum, a third kidney control port being connected to the first circuit is made in the control plate and extends along the circular arc with the first radius ($R_1'$), and a fourth kidney control port being connected to the second circuits made in the control plate and extends along the circular arc with the second radius ($R_2'$).

2. Hydrostatic piston machine according to claim 1, wherein the control plate has a spherical protuberance and bears against a corresponding spherical indentation of the end face of the cylinder drum.

3. Hydrostatic piston machine according to claim 1, wherein the first and second connecting ducts run parallel to the longitudinal axis of the cylinder drum.

4. Hydrostatic piston machine according to claim 1, wherein the first and/or the second connecting ducts have a radial direction component with respect to the longitudinal axis of the cylinder drum.

5. Hydrostatic piston machine according to claim 1, wherein the connecting ducts opening out at the end face of the of the cylinder drum with the smaller distance ($R^1$) from the longitudinal axis of the cylinder drum have a radial direction component directed in the direction of the end face towards the longitudinal axis of the cylinder drum.

6. Hydrostatic piston machine according to claim 1, wherein the number of cylinder bores made in the cylinder drum of the common divided circle is even.

7. Hydrostatic piston machine according to claim 6, wherein the number of cylinder bores of the first group is identical to the number of cylinder bores of the second group.

8. Hydrostatic piston machine according to claim 6, wherein the first group and the second group each have an odd number of cylinder bores.

9. Hydrostatic piston machine according to claim 1, wherein pistons are arranged longitudinally displaceably in each of the cylinder bores of the first group and in each of the cylinder bores of the second group, and the pistons are supported on a pivoting plate which, in order to reverse the working direction of the piston machine, is pivotable in two directions starting from an orthogonal position with respect to the longitudinal axis of the cylinder drum.

* * * * *